United States Patent [19]

Coulombe

[11] 4,121,526

[45] Oct. 24, 1978

[54] ELECTRONICALLY CONTROLLED SEWING MACHINE WITH CAM CONTROLLED FEED

[75] Inventor: Lionel J. Coulombe, Matawan, N.J.

[73] Assignee: The Singer Company, New York, N.Y.

[21] Appl. No.: 838,418

[22] Filed: Sep. 30, 1977

[51] Int. Cl.[2] ..... D05B 27/00; D05B 3/02; D05B 3/04

[52] U.S. Cl. ..... 112/158 E; 112/215; 112/158 B

[58] Field of Search ..... 112/158 E, 215, 216, 112/203, 158 B, 158 A

[56] References Cited

U.S. PATENT DOCUMENTS

| | | | |
|---|---|---|---|
| 2,690,724 | 10/1954 | Eisenbeiss | 112/215 X |
| 3,596,618 | 8/1971 | Goldbach | 112/158 B |
| 3,855,956 | 12/1974 | Wurst | 112/158 E |
| 3,874,312 | 4/1975 | Cook et al. | 112/158 E X |
| 3,881,433 | 5/1975 | Davidson | 112/158 E |
| 3,976,019 | 8/1976 | Allen et al. | 112/158 E |
| 3,977,338 | 8/1976 | Wurst et al. | 112/158 E |
| 4,048,932 | 9/1977 | Odermann et al. | 112/158 E |
| 4,052,946 | 10/1977 | Rydz et al. | 112/158 E |
| 4,063,525 | 12/1977 | Sasaki | 112/158 A |

*Primary Examiner*—Werner H. Schroeder
*Assistant Examiner*—Andrew M. Falik
*Attorney, Agent, or Firm*—Robert E. Smith; William V. Ebs; Edward L. Bell

[57] ABSTRACT

This disclosure relates to electronically controlled sewing machines having logic circuitry to provide input signals corresponding to stitch position coordinates for selected patterns and actuator means responsive to selected ones of said signals for positioning the needle means and a cam controlled feed means responsive to said signals for controlling the feed of a fabric relative to the needle means.

11 Claims, 7 Drawing Figures

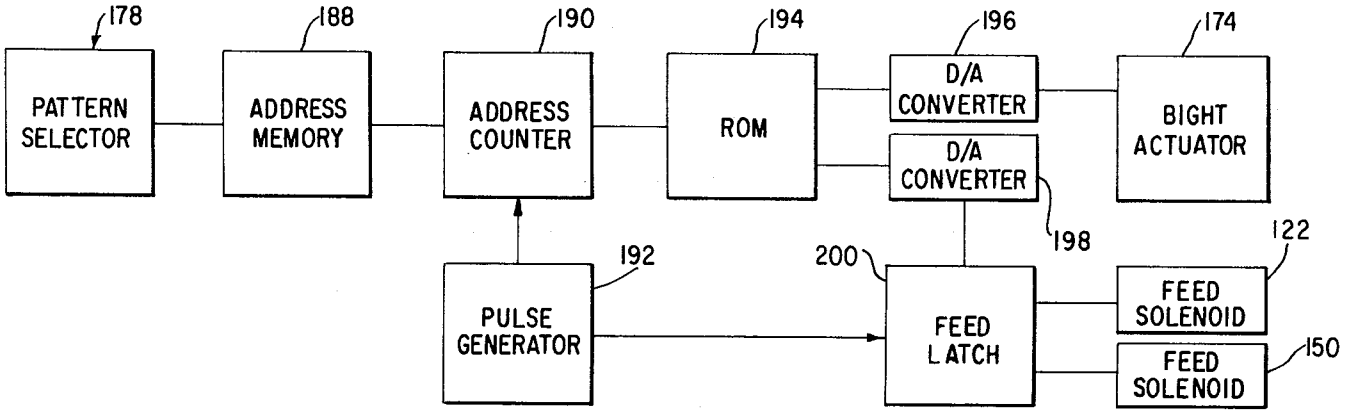
Fig. 6
Fig. 7
| PATTERN | A | B | C | D | E | F | G | H |
|---|---|---|---|---|---|---|---|---|
| FEED SOLENOID 122 | OFF | OFF | ON | ON | OFF | ON | OFF | OFF |
| FEED SOLENOID 150 | OFF | OFF | OFF | OFF | OFF | OFF | ON | ON |
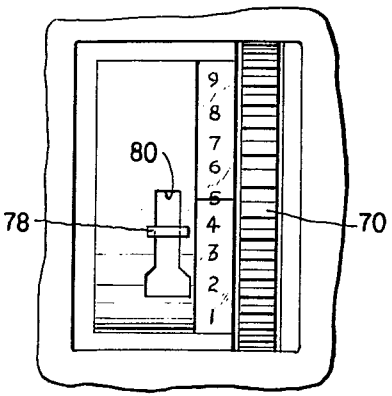
Fig. 2

ELECTRONICALLY CONTROLLED SEWING MACHINE WITH CAM CONTROLLED FEED

BACKGROUND OF THE INVENTION

Electronically controlled sewing machines of the type using electronic logic to control the sewing instrumentalities, such as for example, the needle means and the feed control means, are in and of themselves known in the art. See for example, U.S. Pat. No. 3,855,956 issued Dec. 24, 1974 and U.S. Pat. No. 3,984,745 issued Oct. 5, 1976, both of said patents being assigned to the same assignee as the present invention. Machines of this type have gained a relatively rapid and popular acceptance in the marketplace and have many desireable features. Machines having cam controlled feed mechanisms have also been well known in the art, as for example, illustrated by U.S. Pat. No. 3,585,876 issued July 22, 1971 and U.S. Pat. No. 3,639,900 issued June 25, 1972, both of said patents also being assigned to the same assignee as the present invention. Insofar as feed control mechanisms are concerned, the cam controlled feed type machines have proven to be desireable mechanisms in that they are relatively durable and are able to absorb the variable feedback forces generated by fabrics of different thickness and density which may be sewn on the machine and which forces may in and of themselves have an effect on the operation of the feed mechanisms. Also, with respect to the aforementioned cam controlled feed type machines, the feature of being able to manually select some feeding features is desireable while the manual selection of other features, such as for sewing buttonholes, has been relatively complicated for the operator.

It is an object of the present invention to provide a sewing machine in which the feed may be manually controlled for certain fabric feeding operations, such as for altering stitch length and initiating reverse feed, while other feed characteristics will be automatically controlled for certain feed patterns in combination with automatically controlled bight or needle patterns. It is another object of the invention to provide a durable feed control mechanism in an electronically controlled sewing machine.

Other objects and advantages of the invention will be best understood when reading the following detailed description with the accompanying drawings wherein:

FIG. 2 is a partial plan view of a part of the control panel for the feed mechanism;

FIG. 6 is a functional block diagram of the electronic control circuitry for the sewing machine illustrated in FIG. 1.

FIG. 7 is a chart indicating some patterns producible on the sewing machine of FIG. 1

DETAILED DESCRIPTION OF A PREFERRED EMBODIMENT

Figure 1:
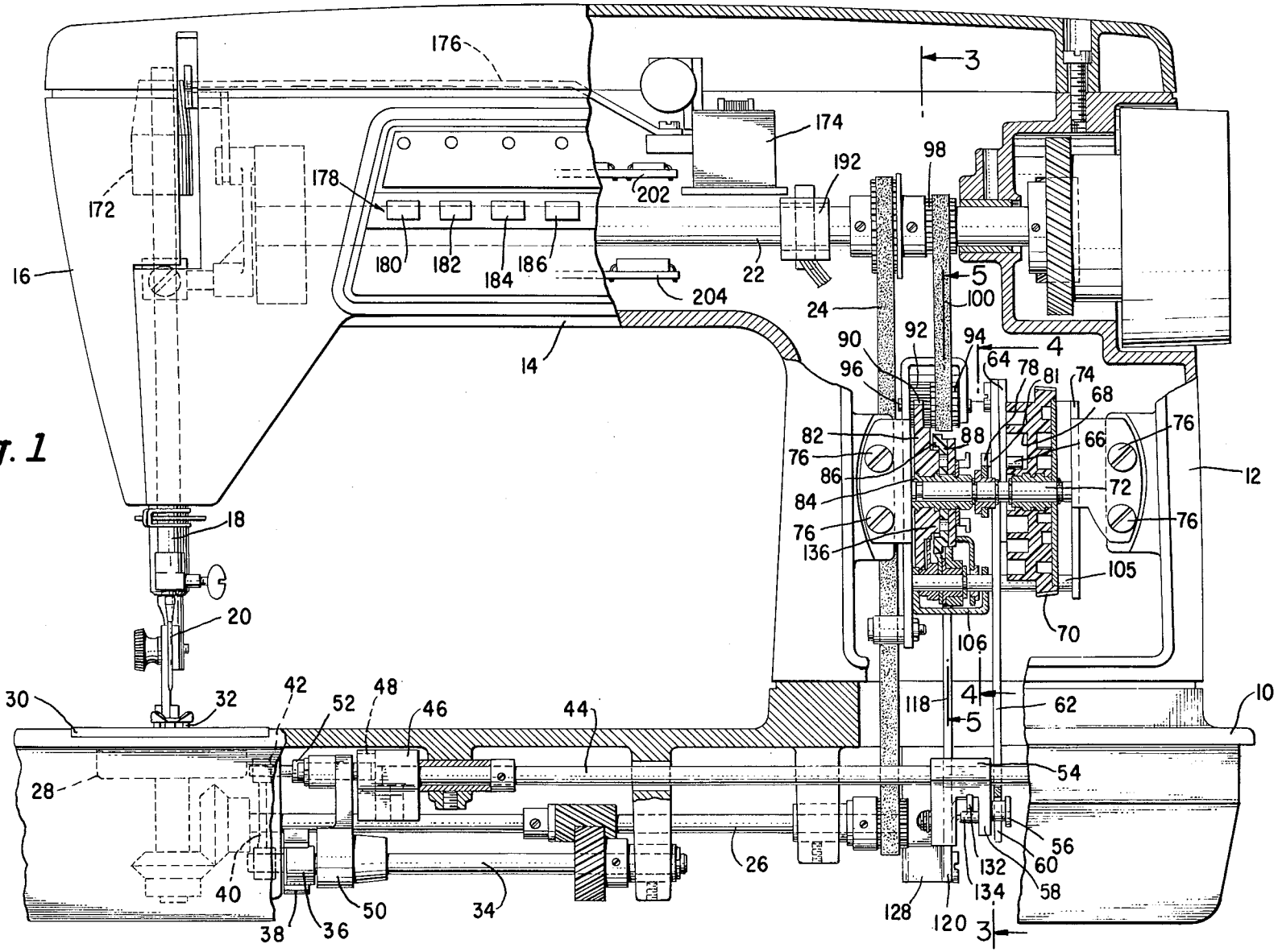
FIG. 1 is a front plan view of a sewing machine incorporating the present invention with portions of the machine broken away for purposes of illustration.

Referring to FIG. 1, there is shown therein a sewing machine including a bed portion 10 from which arises a standard 12 connected to an arm portion 14 overhanging the bed 10 and terminating in a head portion 16. Included in the head portion 16 is an endwise reciprocating needle bar 18 having a needle 20 connected at its lowermost end thereof. An arm shaft 22 is disposed in the arm portion and is suitably connected to the needle bar for initiating endwise reciprocating motion thereof. A drive belt 24 is connected between the arm shaft 22 and a looper drive shaft 26 for driving a rotary looper 28 in timed relationship with the reciprocating needle for concatenating threads to form stitches in a fabric fed across the throat plate portion 30 by a feed dog 32, as will be described more fully hereinafter. The looper drive shaft 26 has drivingly connected thereto a feed drive shaft 34 by gears, as illustrated, which has at its end adjacent the looper 28, a cam 36. The cam 36 has a pitman 38 connected thereto, which in turn is connected to suitable linkage generally designated at 40, for transmitting motion from the pitman 38 to a feed dog drive bar 42 which is connected to the feed dog 32 to initiate lift motion to said feed dog 32 so that the feed dog may raise and lower during the feeding cycle. Also supported in the bed portion 10, for rotation relative thereto, is a feed regulator shaft 44, which has fixed at one end thereof near the feed mechanism a feed regulator block 46 in which is disposed a guideway slideably receiving a slide block 48. The slide block 48 is connected to a pitman 50 which is drivingly received at one end thereof on the feed drive shaft 34 and has its other end connected to a link 52 connected to the feed bar 42. During rotation of the feed drive shaft 34, motion will be imparted to the drive bar 42 through the pitman 50 which motion will be regulated in accordance with the inclination of the feed regulator block and the slide block 48. Thus, the extent of the forward and reverse movement of the feed dog 32 will be determined in accordance with the inclination of the feed regulator block 46. The mechanism thus far described is well known in the sewing machine art and reference may be had to U.S. Pat. No. 3,593,769 assigned to the same assignee as the present invention.

In order to vary the position of the slide block 48 within the feed regulator block 46 and thus the extent of back and forth movement of the feed dog 32, a feed regulator bracket 54 is carried on feed regulator shaft 44 at the opposite end from the block 46, and carries a flanged stud 56 on a leg 58 thereof. The forked end 60 of a stitch length regulator link 62 is disposed about the stud 56 and the link 62 has an arm 64 pivotally connected at its opposite end which arm 64 carries a pin 66 disposed in an internal cam 68 formed in a stitch length regulator dial member 70. The dial member 70 is fixedly carried on a shaft 72 supported in a frame 74 suitably carried by the machine frame as by screws 76 or the like. The internal cam 68 in the dial member 70 is designed such that, as the cam is rotated, rocking motion will be imparted to the feed regulator link 62 which will be transmitted through the forked end 60 thereof to the stud 56 and regulator bracket 54 to rock the shaft 44. The rocking motion of the shaft 44 will be transmitted to the feed regulator guide block 46 and thus vary its inclination and the extent of the feed motion of the feed dog 32 in accordance with the position of the dial 70. As seen in FIG. 2, the dial member 70 is provided with indicia to indicate the stitch length selected.

The shaft 72 also has disposed thereon a reverse lever 78 (FIGS. 1 and 2) which has a finger engaging portion extending through a slot 80 in the cover plate of the machine, as illustrated in FIG. 2. The reverse lever 78 is pivotally supported on said shaft 72 and has a pin 81 at its end opposite end from the finger engaging portion and extending laterally therefrom toward the regulator link 62 such that when the lever 78 is depressed, the pin 81 will engage underneath a link (not shown) connected to the regulator link 62 to lift the link 62 which due to the curvature of the link 62 will cause the regulator bracket 54 on the shaft 44 to pivot in a direction which will result in the regulator slide block 46 pivoting to a position wherein the feed motion of the feed dog 32 will be in a reverse direction or in a direction towards the operator.

Figure 3:
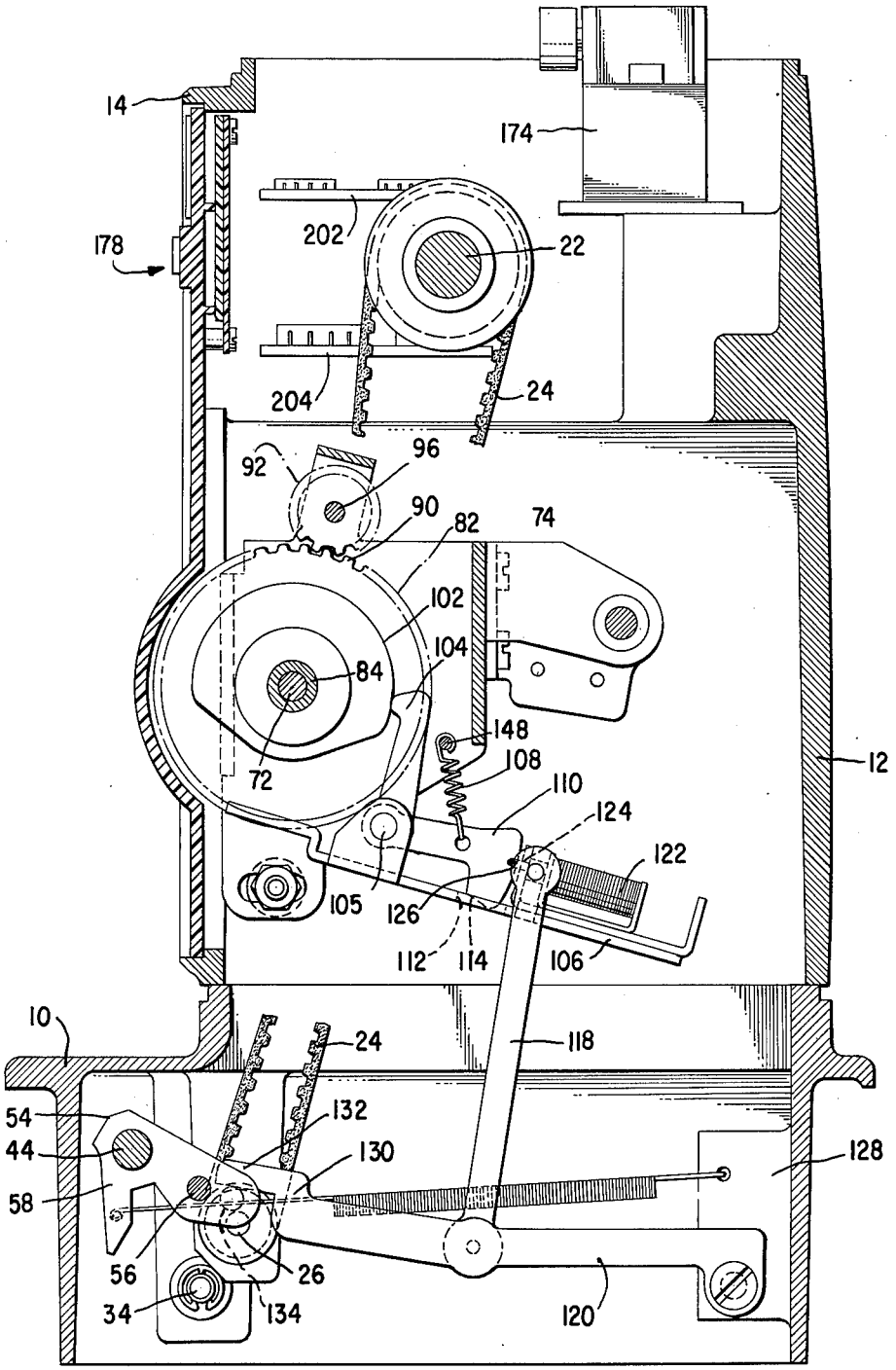
FIG. 3 is a cross-sectional view of the sewing machine illustrated in FIG. 1 and taken along line 3—3 of FIG. 1.

The cam control feed mechanism will now be described. As shown in FIGS. 1 and 3, a composite gear cam member 82 is fixedly supported on a bushing 84 supported for rotation with respect to the shaft 72. Also supported on the bushing 84, are a pair of cams 86 and 88 which are capable of rotation relative to said bushing 84. The functions of the cams 86 and 88 will be more fully described hereinafter. The gear portion 90 of the composite gear cam 82 is disposed in meshing engagement with a gear 92 which along with a gear 94 is fixed to a shaft 96 disposed for rotation in a U-shaped portion of the frame 74, as illustrated in FIG. 1. The gear 94 is coupled to a gear 98 on the arm shaft by a drive belt 100 so that as the arm shaft 22 of the machine rotates, the gear 90 will be driven in timed relationship therewith. The composite gear cam 82 is also provided with a cam portion having a cam surface 102 thereon which is traced by a cam follower 104 which in turn is pivotally supported on an upstanding bracket of a feed driving plate 106, as illustrated in FIG. 3. The cam follower 104 is biased into following engagement with the cam surface 102 by means of a spring 108 connected to the frame portion 74 at one end thereof and to a leg 110 of the cam follower 104. It will be apparent therefore, that while the machine is operating, the cam surface 102 and the cam follower 104 will be in constant driving engagement and the follower will be pivoted in accordance with the shape of the cam surface 102.

The feed drive plate 106 is provided with an aperture 112 therein, in which is received a finger portion 114 of the leg 110 of the cam follower 104. The feed drive plate is also supported near one end for relative pivot motion about a pin or shaft 105 carried by the frame 74. A link member 118 is pivotally connected to an upstanding bracket portion of the feed drive link 106 at one end thereof and is pivotally connected to a reverse link member 120 at the other end thereof in the bed of the machine. The link 118 serves to support the feed drive bracket in an elevated position as shown in FIG. 3, and to transmit motion to the reverse link member 120 from the feed drive bracket should such motion be initiated thereby. A solenoid or electromagnetic actuator 122 is also fixed to the feed drive bracket 106 and has an armature therein with an extension 124 which is adapted to be received in a slot 126 in the leg 110 of the cam follower 104. The arrangement is such that, unless the solenoid is actuated by an appropriate electrical signal, the armature portion 124 will not be in engagement with the slot 126.

Referring again to FIGS. 1 and 3, the reverse arm member 120 is pivotally supported on a portion of the bed of the machine as on a bracket 128 at one end thereof and its other end is provided with a fingerlike portion 130 which is bent at a double right angle so that a finger extension portion 132 thereof overlies a pin 134 extending from the leg 58 of the regulator bracket 54 as best shown in FIG. 1. Should the reverse arm 120 be lowered as viewed in FIG. 3, the finger portion 132 will engage the pin 134 of the regulator bracket 54 to pivot the regulator bracket in a direction such that the feed regulator shaft will rotate in a direction to initiate reverse feed movement of the feed dog 32. As briefly mentioned above, the cam follower 104 will be constantly moved during operation of the machine due to its engagement with the cam surface 102 which will rock the cam follower without any direct action or driving force being provided thereby, unless the solenoid 122 is actuated. Without actuation of the solenoid 122, the cam follower 104 will rock with the finger portion thereof merely passing through the aperture 112 in the feed drive plate 106 without any work output therefrom. As will be explained more fully hereinafter, means are provided for selectively connecting an electrical signal to the solenoid 122 and when this occurs, the solenoid armature extension 124 will engage the slot 126 in the leg 110 of the cam follower 104 to thereby couple the solenoid and the feed driving plate with the cam follower 104. As the cam rotates, the action will be transmitted through the cam follower 104 to the feed drive plate 106 and to the link 118 connected thereof and ultimately to the feed reverse arm 120 to initiate reverse feed as described above. The cam surface 102 is designed so that reverse action or reverse feed will be initiated in a relationship of one reverse feed to every two forward feed steps. Again, as will be more fully described hereinafter, the electrical signal coupled to the solenoid 122 may be done for selected patterns only in which it is desired to have a cam controlled feed in combination with a patterned bight control.

Figure 4:
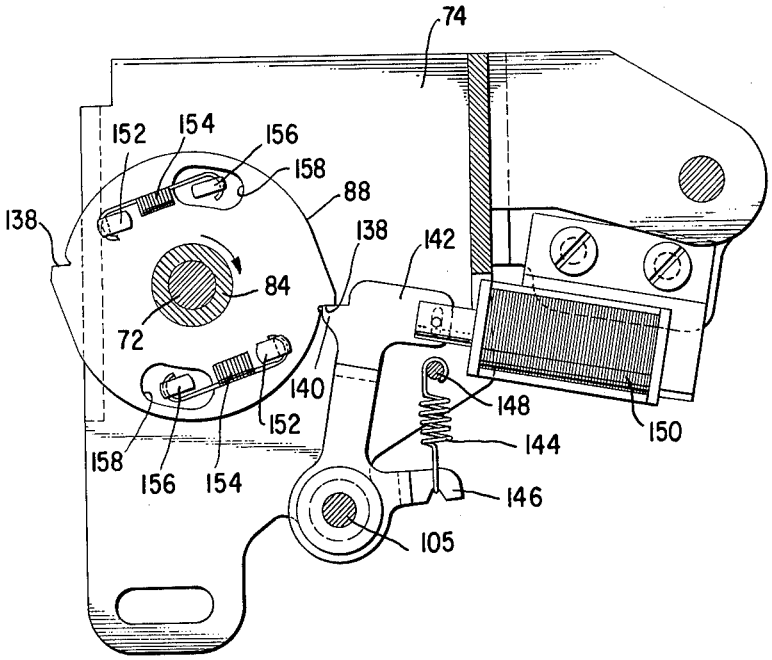
FIG. 4 is a partial sectional view showing a portion of the cam control feed mechanism and taken along line 4—4 of FIG. 1.
Figure 5:
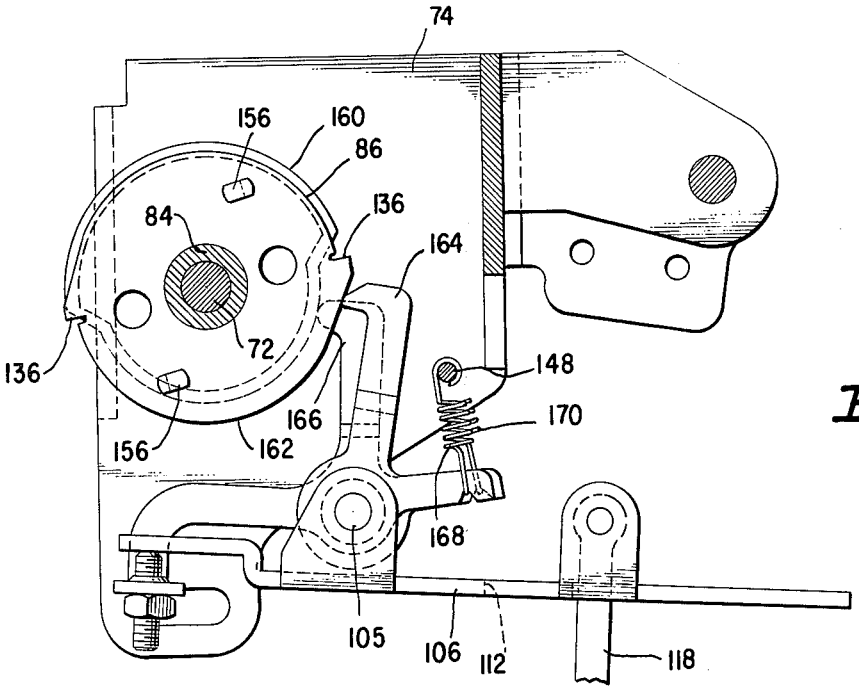
FIG. 5 is a view similar to FIG. 4 taken along line 5—5 of FIG. 1.

Further in accordance with the invention, a novel buttonhole mechanism is provided and is best illustrated in FIGS. 1, 4 and 5. As mentioned above, the shaft 72 carrying the gear-cam 82 also carries cams 86 and 88 which are supported on the bushing 84, as best illustrated in FIG. 1. As also illustrated in FIG. 1, the cam 86 has a cutout portion adjacent the gear-cam 82 into which is received a protruding portion 136 of the gear-cam 82. Although not illustrated, the relationship between the cutout portion of the gear 86 and a protruding portion 136 of the gear-cam 82 is such as to provide a slip clutch which will cause the gear-cam 82 to drive the cam 86 unless the cam 86 is restrained by a force strong enough to cause the clutch to slip. Any known type of slip clutch may be used between the gear-cam 82 and the gear 86 and no invention is alleged in any specific form of slip clutch.

Referring to FIG. 4, it will be seen that the cam 88 is provided with raised portions 138 thereon, one of which is illustrated as engaging a finger 140 of a cam follower 142. The cam follower 142 is supported on shaft 105 for rotation relative thereto and is biased into engagement with the cam 88 by a spring 144 fixed to a leg 146 of the cam follower 142 at one end and at its other end to a pin 148 on the frame 74. As further illustrated in FIG. 4, an electromagnetic actuator or solenoid 150 is fastened to the frame 74 on one leg thereof, as illustrated, and, as will be more fully described hereinafter, is selectively actuated by a control signal to retract the cam follower 142 from locking engagement with the raised portions 138 of the cam 88 to permit the cam 88 to be rotated on the shaft 72. The cam 88 is further provided with a pair of spaced protruding legs 152, each of which carries a spring 154 connected at its other end to a pair of legs 156 fixed to the cam 86 and protruding through apertures 158 in the cam 88, as best illustrated in FIG. 4. The arrangement is such that when the solenoid 150 is actuated to pull the cam follower away from the locking cam 88, the restraint on the slip clutch will be removed so that the gear-cam 82 will then drive the cam 86 along with the cam 88 due to the coupling between the legs 152 and 156 on a cam 88 and 86, respectively.

As best illustrated in FIG. 5, the cam 86 is provided with a double cam track 160 and 162 for forming the two sides of a buttonhole. A pair of cam followers 164 and 166 are disposed in contact with the cam tracks 160 and 162 respectively, and are fixed to shaft 105 for rotation therewith and are biased into contact with the cam tracks 160 and 162 by springs 168 and 170 respectively, as illustrated in FIG. 5. As described above and as also illustrated in FIG. 5, the feed drive plate 106 is drivingly connected with the shaft 105 so that rocking motion imparted to the cam followers 164, 166 will be transmitted through shaft 105 to the feed drive plate 106 with resultant motion being transmitted to the link 118 on the reverse arm 120. When the solenoid 150 is actuated to permit rotation of the cam 88, one of the cam followers 164, 166 will be rotated by a respective cam track 160 or 162 to initiate a direction of feed corresponding to the cam track in the manner as described above. As will be more fully described hereinafter, the cams are arranged such that the locking cam 88 is unlocked to permit the buttonhole cam 86 to be driven for a halfcycle to form a bartack and one leg of a buttonhole. Upon selective energerization of the solenoid 150, the cam 86 may be again be permitted to rotate such that the other cam surface 160 or 162 will initiate motion of a cam follower 164 or 166 to form a bartack in the other leg of the buttonhole.

The mechanism for initiating lateral jogging movement of the needle bar 18 and the needle 20 is of a type known in the art and may comprise in general a gate 172 (FIG. 1) which is mounted in the sewing machine frame for relative lateral movement and in which is supported the needle bar 18. In order to initiate lateral movement of the needle bar gate 172, an electromagnetic actuator or linear motor is provided to which is connected a drive link 176 having its other end pivotally connected to the needle bar gate 172 so that reciprocating movement of the link 176 initiated by the actuator 174 will be transmitted to the gate 172. Reference may be made to U.S. Pat. No. 3,984,745 issued on Oct. 5, 1976, and assigned to the same assignee as the present invention, for a more detailed description of the bight actuating means for the needle bar 18.

As briefly mentioned above, electronic control circuit means is provided for controlling the lateral jogging movement of the needle and also the feed mechanism for producing ornamental patterns. With reference to FIG. 6, wherein there is shown a diagrammatic representation of a functional electronic circuit for the controlled aforementioned, as seen therein, a pattern selector is provided in which is included the pattern selector buttons 180–186 (FIG. 1) which permit the operator to select any one of a number of patterns, only four of which being illustrated in FIG. 1 although more or less buttons may be provided according to the number of patterns. The pattern selector 178 is connected to an address memory 188 which contains encoded data in binary form to produce a predetermined specific binary number on its output lines for a pattern selected by the operator by depressing one of the selector buttons 180–186. An address counter 190 is connected to the address memory 188 and is coupled with a pulse generator 192, physically illustrated in FIG. 1 as being associated with arm shaft 22, so that the data from the address memory will be addressed to a pattern read-only-memory 194 in timed relation to the operation of the machine. The pattern read-only-memory has stored therein the stitch position coordinate data for the needle and the feed mechanism to produce ornamental patterns corresponding to the selections from the pattern selector 178. When the read-only-memory 194 is addressed with particular coded words, pattern information will be released and according to the pattern selection will be fed to the feed solenoids 122 and 150 as well as to the bight actuator 174 with such signals being in digital form. These digital signals will be converted to analog signals by a digital-to-analog converter 196 for the bight circuit and 198 for the feed circuit, as illustrated. As also shown in FIG. 6, the pulse generator 192 is connected to a feed latch circuit 200 so that the feed signals will be fed to the feed solenoids 122 and 150 in timed relationship to the needle so that feed will only take place while the needle is withdrawn from a fabric. The elements 188–200 may take the form of printed circuit components which are physically represented by printed circuit boards 202 and 204 shown in FIG. 1.

The operation of the machine is generally as follows: When a push-button, as for example push-button 184, is selected by the operator for reproducing a pattern which may be identified by indicia shown on the face plate of the machine, a predetermined specific binary number will be selected by the pattern selector 178 from the address memory 188 and as the counter 190 is pulsed by the pulse generator 192 the binary number will be addressed to the read-only-memory 194. The memory 194 contains stitch position coordinate data corresponding to the pattern selected by the selector switch 184 which data will be released to provide specific signals to the actuator 174 for positioning the needle at the proper stitch position coordinates during rotation of the arm shaft 22 and reciprocation of the needle 20. At the same time, stitch position coordinate data will be supplied in accordance with the selected pattern to selectively operate the feed solenoid 122 so that forward and reverse feed motion for the feed dog 32 will be provided in accordance with rotation of the cam surface 102 for transmitting motion to the feed drive plate 106 through the cam follower 104. As will be apparent, the feed solenoid 122 will be turned off and on at appropriate times in accordance with the signals provided from the memory 194 for the particular pattern selected. If it is desired to produce a buttonhole, a switch corresponding to a buttonhole selection may be depressed for selection of one side of the buttonhole which will provide, through the logic circuitry, a signal to feed solenoid 150 to set the buttonhole cam mechanism in motion as described above, whereupon a bartack will be produced at the top of the buttonhole and then one side of the buttonhole will be sewn. When it is desired to make the other side of the buttonhole, the machine will be stopped and another selector button corresponding to the other side of the buttonhole depressed whereupon a bartack on the other side of the buttonhole will be sewn to close off that side of the buttonhole and the other side of the buttonhole will then be sewn to meet the first sewn bartack to complete the entire buttonhole at the desired length.

With reference to FIG. 7, there is illustrated therein some of the patterns which may be reproduced by the machine by use of the combination electronic bight mechanism and cam controlled feed mechanism. With reference to the table shown in FIG. 7, it will be seen that the feed solenoid 122 which produces a two forward one reverse cam feed for the fabric will not be actuated in those patterns where no reversal of feed is required, namely the patterns identified in columns A, B, E, G, and H. Where reversal of feed is required to reproduce the pattern through use of a cam controlled feed, the feed solenoid will be actuated, as for example those patterns shown in columns C, D, and F. With reference to the feed solenoid 150, it will be seen that the solenoid 150 is only on when those patterns are selected which correspond to the two sides of the buttonhole.

It will be seen from the above description, that a novel combination of an electronically controlled bight and feed mechanism is provided wherein the operator may select a variety of ornamental patterns simply by pushing a switch whereupon the control circuitry and associated mechanism will reproduce the pattern in accordance with stored information. The invention contemplates the use of a cam controlled feed mechanism which is a positive mechanical device but which is controlled by electronic signals from electronic logic circuitry which initiate action of electromagnetic actuators for setting the cam control mechanism and buttonhole mechanism into motion. The cam control mechanism of the invention also includes means for manually adjusting the stitch length and for reversing the direction of feed of the fabric by manual means, if desired. The construction of the cam control feed mechanism is such that it is able to substantially absorb forces imposed thereon which forces are in reaction to the feeding of the fabric which may be of different thicknesses and densities, which thereby results in a positive and accurate feed mechanism.

While the invention has been described above in its preferred embodiment, it will be obvious to those skilled in the art that various modifications and changes will be made without departing from the spirit and scope of the appended claims. For example, it is possible to substitute other feed cams for the feed cam 82 or add other feed cams for operating the feed mechanism of the machine in accordance with desired ornamental patterns. Also, the novel cam controlled feed mechanism of the invention may be used in combination with other electronically controlled bight mechanisms for the needle.

Having thus set forth the nature of this invention, what is claimed herein is:

1. In a sewing machine having stitch forming instrumentalities for producing successive stitches in a variety of stitch patterns including a needle supported for endwise reciprocating and relative lateral jogging movements, a work feed means including mechanism for feeding a fabric relative to said needle between needle penetrations, a needle jogging mechanism for initiating relative jogging movement of said needle, electric motor means operably connected to said jogging means and responsive to stitch position coordinate signals for initiating relative lateral jogging movement of said needle to stitch position coordinates corresponding to preselected stitch position coordinate signals, memory means for storing stitch position coordinate data, means for extracting stitch position coordinate data from said memory means and for converting data from said memory means into stitch position coordinate signals at least some of which are fed to said electric motor means for controlling said electric motor means, and said work feed mechanism including cam feed means having at least one cam with said cam having a cam surface with work feed pattern information thereon, cam follower means disposed for selective operative engagement with said cam surface, means connecting the cam follower means with the feed regulator means effective to transmit said work feed pattern information to the feed regulator means whenever the said cam surface is engaged by the follower means, work feed electric motor means operably connected to said cam follower means and being responsive to stitch position coordinate signals extracted from said memory means for initiating operative engagement between said cam follower means and said cam feed means such that said cam follower means will be operative for transmitting work feed pattern information in accordance with pattern information extracted from said memory means.

2. In a sewing machine as recited in claim 1 further comprising at least one other cam having a cam surface with work feed pattern information thereon, said cam follower means disposed for selective operative engagement with the cam surface of said other cam for transmitting work feed pattern information therefrom to said work feed mechanism, said work feed electric motor means being operative for selective actuation of said other cam follower means for selective engagement of said other cam follower with said cam surface of said other cam, such that said other cam follower means will be brought into operative relationship with said cam in accordance with pattern information extracted from said memory means.

3. In a sewing machine as recited in claim 2, wherein said work feed mechanism further includes a fabric engaging feed element operable to feed a fabric relative to a machine working surface and relative to said needle, and a feed regulator member operable for controlling the direction and magnitude of movement of said feed element.

4. In a sewing machine as recited in claim 3 wherein said cam follower means is operably connected to said feed regulator member for selectively controlling movement of said feed element.

5. In a sewing machine as recited in claim 2 wherein said work feed electric motor means comprises a plurality of solenoids, at least one of said solenoids being associated with said one cam and another of which being associated with said other cam.

6. In a sewing machine as recited in claim 2 further comprising operator influenced manual control means for manually controlling the magnitude and direction of fabric feed.

7. In a sewing machine as recited in claim 2 further comprising operator influenced selector switch means, said switch means being connected to said means for extracting stitch position coordinate data from said memory means for automatically producing stored stitch position coordinate data in accordance with operator influenced selections.

8. In a sewing machine having stitch forming instrumentalities for producing successive stitches in a variety of stitch patterns including a needle supported for endwise reciprocating and relative lateral jogging movement, a work feed means including mechanism for feeding a fabric relative to said needle between needle penetrations, a needle jogging mechanism for initiating relative jogging movement of said needle, said work feed mechanism including fabric engaging feed means operable to feed a fabric relative to a machine working surface and said needle, a feed regulator means operable for controlling the direction and magnitude of movement of said fabric engaging feed means, a cam control feed means operably associated with said feed regulator means and including at least one cam having a cam surface with work feed pattern information thereon, cam follower means associated with said one cam for selective engagement with said cam surface means connecting the cam follower means with the feed regulator means effective to transmit said work feed pattern information to the feed regulator means whenever the said cam surface is engaged by the follower means, memory means for storing stitch position coordinate data, means for extracting stitch position coordinate date from said memory means and for converting said data into stitch position coordinate electrical signals, and electric motor means operably connected to said cam follower means for causing said cam follower means and said one cam to be selectively disposed in operative relationship, said electric motor means being responsive to stitch position coordinate signals for activating said electric motor means such that work feed pattern information will be transmitted from said cam surface to said regulator means in accordance with the selective actuation of said electric motor means.

9. In a sewing machine as recited in claim 8 wherein said cam means includes a second cam, a cam follower locking member for preventing rotation of said second cam, said electric motor means being operative in response to selected stitch position coordinate signals for causing said cam follower locking member to disengage said one cam and permit rotation thereof.

10. In a sewing machine as recited in claim 9, further comprising a third cam, said third cam having a cam surface with work feed pattern information thereon said cam follower means including a cam follower disposed in operative relationship with said cam surface of said third cam and being operative for transmitting work feed pattern information to said regulator means when said cam follower locking member is disengaged from said second cam.

11. In a sewing machine as recited in claim 10, said third cam having a second cam surface with work feed pattern feed information thereon, a cam follower disposed in operative engagement with said second cam surface of said second cam, and said electric motor means being operative in response to selected stitch position coordinate signals for operatively coupling said third cam follower to said regulator means.

* * * * *